United States Patent [19]

Shimoda

[11] Patent Number: 4,619,314

[45] Date of Patent: Oct. 28, 1986

[54] DEVICE FOR PREVENTING WEAR OF HEAT TRANSFER TUBES IN FLUIDIZED-BED BOILER

[75] Inventor: Hiromi Shimoda, Hasuda, Japan

[73] Assignee: Ishikawajima-Harima Jukogyo Kabushiki Kaisha, Japan

[21] Appl. No.: 635,244

[22] Filed: Jul. 27, 1984

[30] Foreign Application Priority Data

| | | | |
|---|---|---|---|
| Aug. 5, 1983 | [JP] | Japan | 58-143563 |
| Aug. 5, 1983 | [JP] | Japan | 58-121903[U] |
| Jan. 20, 1984 | [JP] | Japan | 59-6539[U] |

[51] Int. Cl.[4] ..... F28F 19/00

[52] U.S. Cl. ..... 165/104.16; 165/134.1; 122/4 D; 122/6 A; 122/DIG. 13

[58] Field of Search ..... 422/146; 165/134, 104.16; 122/DIG. 13, 6 A, 4 D; 138/110

[56] References Cited

U.S. PATENT DOCUMENTS

| | | | |
|---|---|---|---|
| 915,059 | 3/1909 | Beattie | 122/6 A |
| 2,053,127 | 9/1936 | Biggs | 122/6 A |
| 2,590,465 | 3/1952 | Ris | 165/134 |
| 3,165,286 | 1/1965 | Johnson et al. | 138/110 |
| 4,251,170 | 2/1981 | Sheridan | 138/110 |

FOREIGN PATENT DOCUMENTS

| | | | |
|---|---|---|---|
| 220636 | 4/1962 | Austria | 165/134 |
| 18089 | 2/1983 | Japan | 165/104.16 |

*Primary Examiner*—Albert W. Davis, Jr.

[57] ABSTRACT

A device for protecting wear of heat transfer tubes in a fluidized-bed boiler is disclosed. The protective device is applied to a portion of a heat transfer tube which is strongly and exceedingly attacked by fluidized bed materials, so that the considerable decrease in service life of a heat transfer tube due to wear caused by the attack of fluidized bed materials can be avoided.

5 Claims, 14 Drawing Figures

DEVICE FOR PREVENTING WEAR OF HEAT TRANSFER TUBES IN FLUIDIZED-BED BOILER

BACKGROUND OF THE INVENTION

The present invention relates to a device for preventing wear by fluidizing bed materials of the heat transfer tubes which are immersed in the fluidized bed in a fluidized-bed boiler.

In a fluidized-bed boiler, bed materials are charged into the furnace, and fluidized so that there arises a problem that the heat transfer tubes immersed in the fluidized bed are worn by fluidized bed materials, the heat transfer tubes being in-bed tubes and furnace water wall tubes. As a result, there have been proposed various methods for preventing the wear of surfaces of heat transter tubes, but they are not satisfactory in practice.

One of the objects of the present invention is to effectively prevent wear of heat transfer tubes by fluidized bed materials so that the service life of heat transfer tubes may be prolonged.

Another object of the present invention is to prevent wear of heat transfer tubes by fluidized bed materials without causing any decrease in heat transfer efficiency thereof.

A still another object of the present invention is to provide a device for preventing wear of heat transfer tubes by fluidized bed materials which is very simple in construction so that the device can be fabricated in a simple manner and consequently at less costs.

A further object to the present invention is to provide a device for preventing wear of heat transfer tubes by fluidized bed materials which can be easily applied to them.

To the above and other ends, according to the present invention, a protector made of an anti-wear material is attached to the outer surface of a heat transfer tube which is strongly attached by fluidized bed materials, whereby wear of the heat transfer tube by the fluidized bed materials can be prevented.

DETAILED DESCRIPTION OF THE PREFERRED EMBODIMENTS

Figure 1:
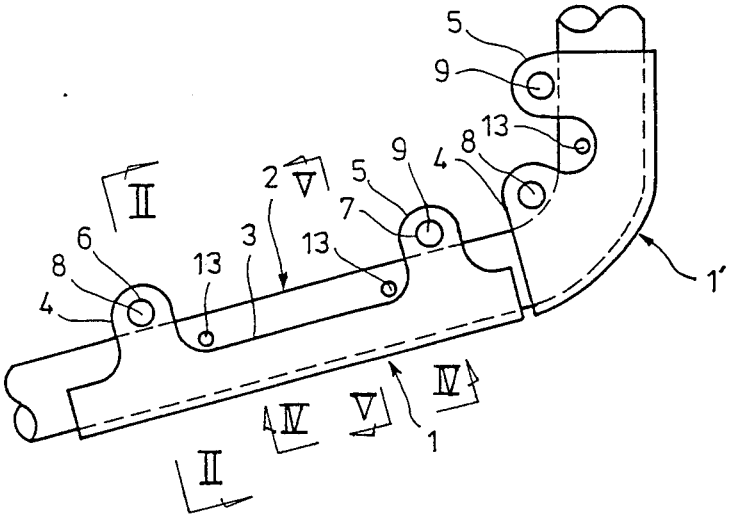
FIG. 1 is a side view of a first embodiment of the present invention.
Figure 2:
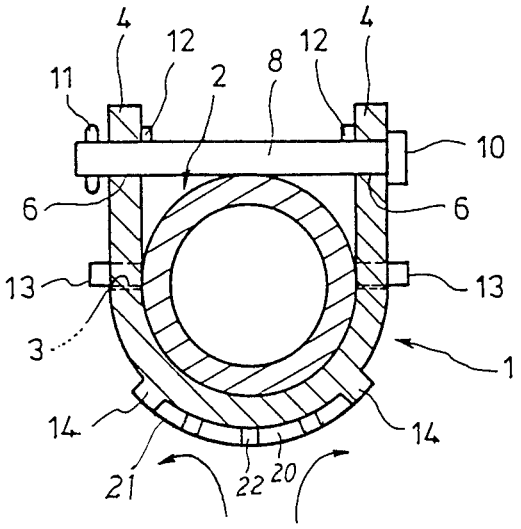
FIG. 2 is a view looking in the direction indicated by the arrows II—II of FIG. 1.

FIG. 1 shows a first embodiment of the present invention and FIG. 2 is a view looking in the direction indicated by the arrows II—II of FIG. 1. Reference numeral 1 designates a protector made of a wear-resisting cast steel (for instance, SCH21 or the like). The protector 1 has a suitable length and is substantially semicylindrical in cross section so that the protector 1 can cover the semicylindrical surface portion of a heat transfer tube 2 in a fluidized bed. Connection projections 4 and 5 U-shaped in cross section extend tangentially from both the widthwise side edge surfaces 3 of the protector 1. The connector projections 4 and 5 are formed with pin holes 6 and 7, respectively, and pins 8 and 9 made of a wear-resisting material are inserted into the pin holes 6 and 7, respectively, so as to connect and support the protector 1. One end of each connection pin 6 or 7 has a head 10 and the other end is provided with a stop 11 which is made of build up welding or by strinking a stud so that the pins 8 and 9 are prevented from being pulled out of the pin holes 6 and 7. Stoppers 12 are also attached to the inner surfaces of the connection projections 4 and 5 so that the pins 8 and 9 can be positively prevented from being pulled out of the pin holes 6 and 7. Engaging studs 13 and 13' are welded to the heat transfer tube 2 adjacent to the widthwise side edge surfaces 3 of the protector 1 and adjacent to the inner end surfaces of the connection projections 4 and 5 so that the displacement of the protector 1 in the longitudinal direction of the heat transfer tube 2 as well as the rotation of the protector 1 about the heat transfer tube 2 can be prevented.

Figure 4:
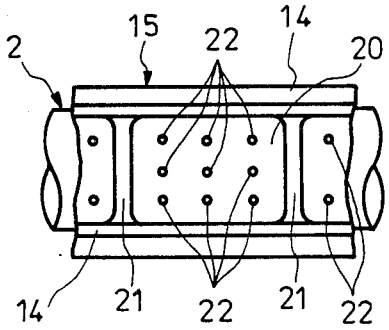
FIG. 4 is a view looking in the direction indicated by the arrows IV—IV of FIG. 1 or 3.
Figure 5:
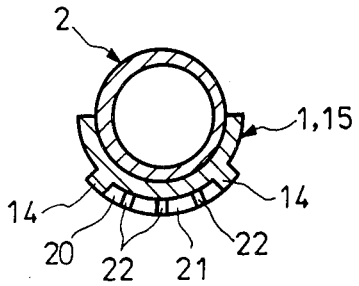
FIG. 5 is a view looking in the direction indicated by the arrows V—V of FIG. 1 or 3.

As best shown in FIGS. 4 and 5, two projections 14, which are circumferentially spaced apart from each other, extend on the lower outer surface of the protector 1 in the axial direction of the heat transfer tube 2. A plurality of circumferentially extending projections 21 are interposed between the axially extending projections 14 and are spaced apart from each other in the axial direction. A plurality of studs 22 made of a wear-resisting material (for instance, SUS310S or the like) extend on the lower surface of the protector 1 at regions 20 each surrounded by the projections 14 and 21 and are arranged like matrix arrays. The fluidized bed materials, which flow upwardly in the fluidized bed as indicated by the arrows in FIG. 2, stike against the projections 14 and 21 and the studs 22 and are decelerated, thereby decreasing wear of the protector 1. Furthermore, fluidized bed materials are caused to make into contact with the projections 14 and 21 so that the fluidized bed materials are accumulated at the corners of the recess defined by the projections 14 and 21 and the protector 1 and new fluidized bed materials strike against the fluidized bed materials accumulated at the corner. As a result, wear of the corners or joints between the projections 14 and 21 and the protector 1 can be prevented. A protector 1' is adapted to be applied to a bent or curved portion of the heat transfer tube 2. In the protector 1', the distance between the connection projections 4 and 5 is less so that only one stud 13 may be provided so as to securely hold the protector 1' in position. Such protection 1' may be provided at its lower outer surface with the projections 14 and 21 of the studs 22.

The heat transfer tube 2 is immersed slantly in a fluidized bed of a fluidized-bed boiler as shown in FIG. 1. In order to apply or attach the wear preventive device of the type described above to the heat transfer tube 2, the protector 1 is fitted over the lower half surface of the heat transfer tube 2 and the pins 8 and 9 extend through the holes 6 and 7 of the connection projections 4 and 5. Thereafter the stoppers 11 and 12 are provided so as to prevent the pins 8 and 9 from being pulled out of the pin holes 6 and 7. Thus the projector 1 is snugly fitted over the heat transfer tube 1 by means of the pins 8 and 9. Thereafter the studs 13 are welded to the heat transfer tube 2 adjacent to the widthwise side edge surfaces 3 of the protector 1 and adjacent to the connection projections 4 and 5. As a result, the displacement of the protector 1 in the axial direction of the heat transfer tube 2 and the rotation of the protector 1 about the heat transfer tube 2 can be prevented so that the protector 1 can be securely held in position.

As described above, the protectors 1 and 1' are fitted over the heat transfer tube 2 so as to cover the lower half surface thereof which is most likely attacked by fluidized bed materials. Therefore wear of the heat transfer tube 2 can be effectively prevented. In addition, the projections 14 and 21 and the studs 22 are provided at the lower half surfaces of the protectors 1 and 1' so that fluidized bed materials are decelerated to flow in the directions indicated by arrows. As a result, the right and left side surfaces of the protectors 1 and 1' and the upper right and left surfaces of the heat transfer tube 2 can be prevented from being strongly attacked by fluidized bed materials. Heat in the fluidized bed is transferred to the heat transfer tube 2 through the protectors 1 and 1' when fluidized bed materials strike against the protectors 1 and 1'. The upper half portion of the heat transfer tube 2 is exposed so that heat from the fluidized bed can be effectively transmitted to the heat transfer tube 2. As a result, even when the protectors 1 and 1' are fitted over the heat transfer tube 2, the heat transfer efficiency will not be greatly adversely affected. Furthermore, the protectors 1 and 1' can be easily attached to the heat transfer tube 2 by means of the pins 8 and 9 and the studs 13.

Figure 3:
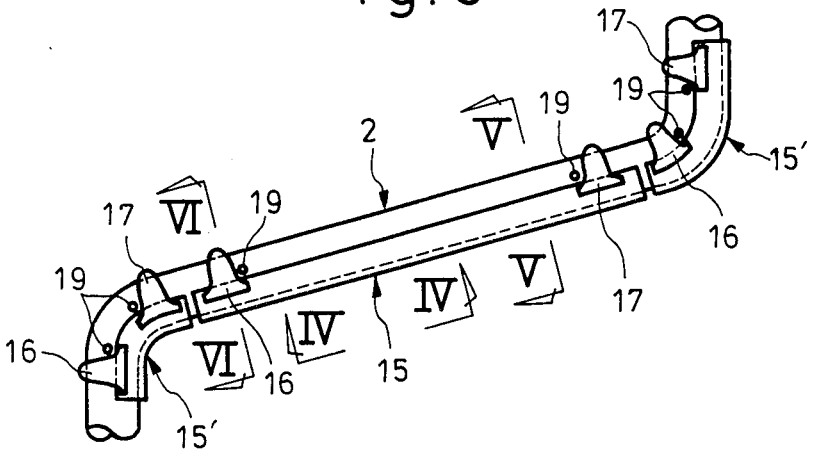
FIG. 3 is a side view of a second embodiment of the present invention.
Figure 6:
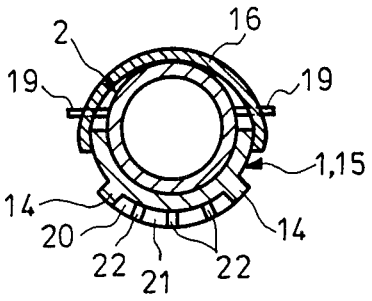
FIG. 6 is a view looking in the direction indicated by the arrows VI—VI of FIG. 1 or 3.

FIGS. 3 and 6 show a second embodiment of the present invention. Protectors 15 and 15' semicircular in cross section are attached to a heat transfer tube 2 by means of a plurality of bands 16 and 17 which are welded. A stud 19 for preventing the rotation of the protector 15 or 15' extends from the heat transfer tube 2 so that the protector 15 or 15' can be securely held in position. As is the case of the first embodiment described above, the projections 14 and 21 and the studs 22 extend from the lower outer surface of the protector 1.

Fluidized bed materials strike against the protectors 15 and 15' so that heat is transferred to a fluid flowing through the heat transfer tube 2. Fluidized bed materials which are made into contact with the protectors 15 and 15' are caused to flow in the axial and circumferential directions and strike against the studs 22 so that fluidized bed materials are decelerated, or strike against the projections 14. Thus, wear of the heat transfer tube 2 and protectors 15 and 15' themselves can be prevented.

The first and second embodiments have been described as being applied or attached to the inclined heat transfer tube 2, but it is of course possible to apply the protectors to a heat transfer tube which extends horizontally.

Figure 7:
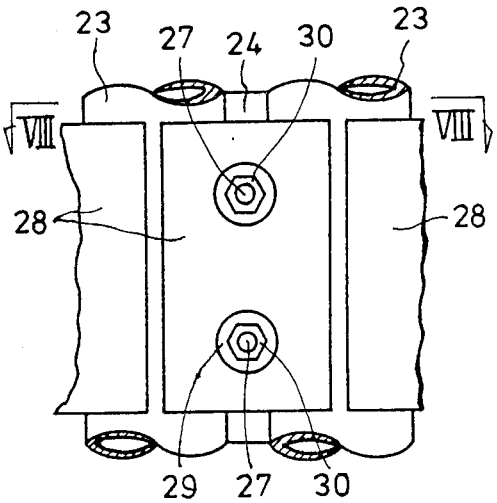
FIG. 7 is a front view of a third embodiment of the present invention.
Figure 8:
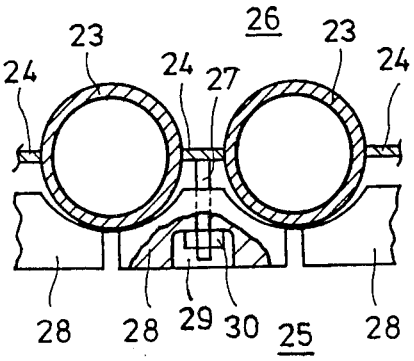
FIG. 8 is a view looking in the direction indicated by the arrows VIII—VIII of FIG. 7.

FIGS. 7 and 8 show a third embodiment of the present invention in which protectors 28 are attached to heat transfer tubes 23 which constitute the furnace walls. The heat transfer tubes 23 vertically extend in parallel with each other and are interconnected by means of a fin 24 so that gases will not escape to the exterior 26 of a furnace. Bolts 27 extend horizontally from the fins 24 toward the interior 25 of the furnace. The protectors 28 which are adapted to cover the inner surfaces of the heat transfer tubes 23 and which are made of a wear-resisting material (for instance, SCH11 or the like) are securely attached with the bolts 27 and wear-resisting nuts 30 in recesses 29. The protectors 28 have curved surfaces so that they can be snugly made into contact with the inner surfaces of the heat transfer tubes 23.

The protectors 28 prevent wear of the heat transfer tubes 23 and heat is transmitted through the protectors 28 to the heat transfer tubes 23 when fluidized media strike against the protectors 28. In the third embodiment, the protectors 28 can be attached to or removed from the inner surfaces of the heat transfer tubes 23 by means of the bolts and nuts 27 and 30 so that the attachment of the protectors 28 can be much facilitated. Furthermore, when the protectors 28 are worn out, new protectors 28 can be attached in a simple manner.

Figure 9:
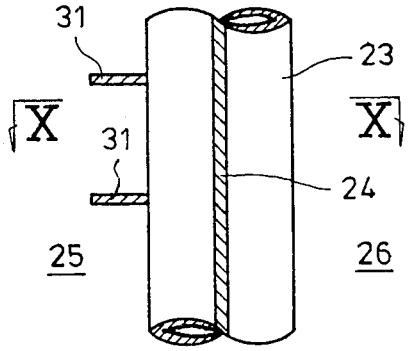
FIG. 9 is a side view of a fourth embodiment of the present invention.
Figure 10:
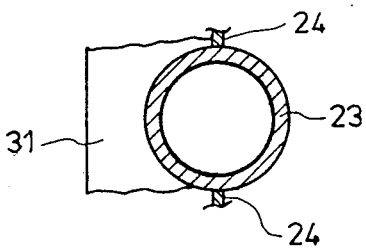
FIG. 10 is a view looking in the direction indicated by the arrows X—X of FIG. 9.

FIGS. 9 and 10 show a fourth embodiment of the present invention in which horizontal fins 31 made of a wear-resisting material extend inwardly from the inner surfaces of the heat transfer tubes 23 and are vertically spaced from each other by a suitable distance.

Figure 11:
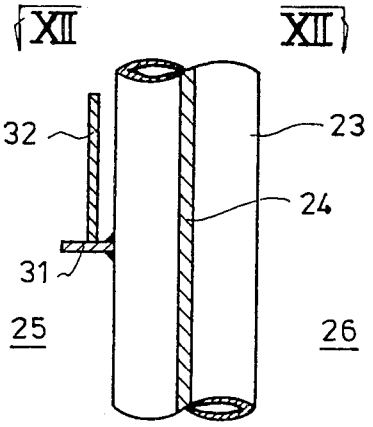
FIG. 11 is a side view of a fifth embodiment of the present invention.
Figure 12:
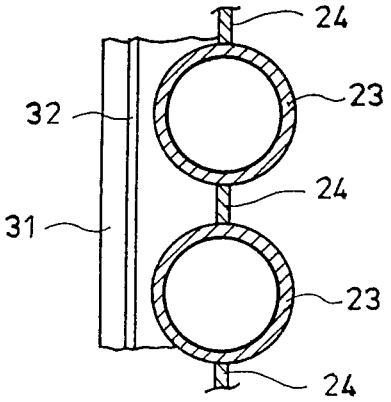
FIG. 12 is a view looking in the direction indicated by the arrows XII—XII of FIG. 11.

FIGS. 11 and 12 show a fifth embodiment of the present invention. A vertical fin 32 made of a wear-resisting material extends upwardly from the horizontal fin 31.

Figure 13:
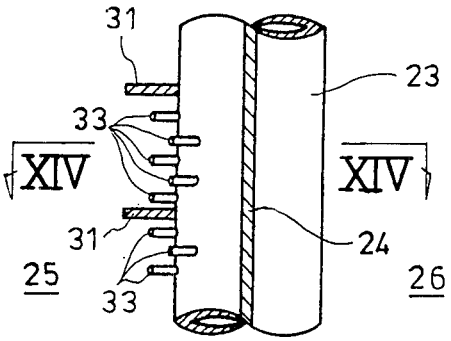
FIG. 13 is a side view of a sixth embodiment of the present invention.
Figure 14:
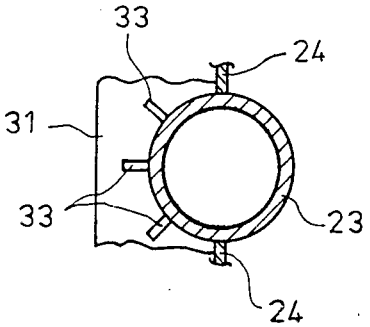
FIG. 14 is a view looking in the direction indicated by the arrows XIV—XIV of FIG. 13.

FIGS. 13 and 14 show a sixth embodiment of the present invention. A plurality of horizontal studs 33 made of a wear-resisting material extend inwardly from the inner surfaces of the heat transfer tubes 23 between the adjacent horizontal fins 31.

When fluidized bed materials strike against these horizontal and vertical fins 31 and 32 and the horizontal struds 33, they are decelerated so that wear of the heat transfer tubes 23 can be prevented. That is, they serve as protectors. Furthermore, the horizontal and vertical fins 31 and 32 and the horizontal studs 33 do not completely cover the inner surfaces of the heat transfer tubes 23 so that a high heat transfer efficiency can be ensured. Therefore, the horizontal and vertical fins 31 and 32 and the horizontal studs 33 may be attached to portions of the surfaces of the heat transfer tubes which are less attacked by fluidized bed materials and at which the drop of heat transfer efficiency is not desired. Of course it is possible to use them in combination with the protectors of the types described with reference to FIGS. 1, 3 and 7.

As described above, according to the present invention, the device for protecting wear of heat transfer tube is very simple in construction and can prevent wear of heat transfer tubes without causing the decrease of the heat transfer efficiency so that the service life of heat transfer tubes can be considerably increased.

What is claimed is:

1. A device for protecting wear of a heat transfer tube in a fluidized bed boiler wherein a lower surface of said tube is exposed to a strong attack from fluidized bed materials, said device comprising a protector made of a wear-resisting material having a substantially semi-circular shape in cross-section so as to cover only said lower surface of said tube, means for attaching said protector to said tube, means on said tube for preventing the displacement of said protector in the axial direction of the tube and the rotation of the protector about said tube, and studs attached to the outer surface of said protector.

2. A device according to claim 1 wherein said protector is attached to the heat transfer tube by means of pins.

3. A device according to claim 1 wherein said protector is attached to the heat transfer tube by means of bands.

4. A device according to claim 1 wherein said protector is positioned with respect to the heat transfer tube by means of studs.

5. A device according to claim 1 wherein projections extend from the outer surface of said protector.

* * * * *